US009222038B2

(12) United States Patent
Dighe et al.

(10) Patent No.: US 9,222,038 B2
(45) Date of Patent: Dec. 29, 2015

(54) PLASMA GASIFICATION REACTOR

(75) Inventors: Shyam V. Dighe, North Huntingdon, PA (US); Mark F. Darr, Acme, PA (US); Ivan A. Martorell, Delmont, PA (US); Pieter van Nierop, Calgary (CA); Aleksandr Gorodetsky, Calgary (CA); Richard Dale Bower, Calgary (CA)

(73) Assignee: Alter NRG Corp., Calgary, Alberta (CA)

( * ) Notice: Subject to any disclaimer, the term of this patent is extended or adjusted under 35 U.S.C. 154(b) by 1506 days.

(21) Appl. No.: 12/378,184

(22) Filed: Feb. 11, 2009

(65) Prior Publication Data

US 2010/0199560 A1 Aug. 12, 2010

(51) Int. Cl.
*C10J 3/18* (2006.01)

(52) U.S. Cl.
CPC ..... *C10J 3/18* (2013.01); *C10J 2200/152* (2013.01); *C10J 2300/093* (2013.01); *C10J 2300/0916* (2013.01); *C10J 2300/0946* (2013.01); *C10J 2300/1238* (2013.01)

(58) Field of Classification Search
CPC ..... C10J 3/08; C10J 3/18; C10J 3/20; C10J 2300/0916; C10J 2300/0946; C10J 2300/093; C10J 2300/1238; C10J 2300/1659; C10J 2200/152; C10J 2200/09; C10J 3/30
USPC ..... 373/18–25; 48/65, 63, 78, 86 R; 219/121.36, 121.37, 121.38, 121.43, 219/121.51, 121.52, 121.59; 110/65 R, 110/345–347; 422/190, 192, 140; 75/459, 75/460, 463, 468, 492
See application file for complete search history.

(56) References Cited

U.S. PATENT DOCUMENTS 2,593,257 A * 4/1952 Bradley et al. ..... 75/460
2,627,455 A 2/1953 Berg
2,875,137 A 2/1959 Lieffers et al.

(Continued)

FOREIGN PATENT DOCUMENTS

GB 1469317 A 4/1977
JP 08-135943 A * 5/1996

OTHER PUBLICATIONS

English translation of Matsizaki (JP 08-135943), May 31, 1996.*

(Continued)

*Primary Examiner* — Hung D Nguyen
(74) *Attorney, Agent, or Firm* — Robert P. Lenart, Esq.; Pietragallo Gordon Alfano Bosick & Raspanti, LLP

(57) ABSTRACT

A plasma gasification reactor vessel having a top section with a conical wall extending up from a bottom section, containing a carbonaceous bed into which plasma is injected by plasma torches, to a roof of the vessel is arranged in ways that can contribute to characteristics of gas flow and solids residence time that are favorable for thoroughness of reactions and yield of useful reactions products. In some cases, such a conical wall is combined in arrangements with other features such as one or more feed ports arranged to give more uniform distribution including examples with a feed port that has a distributive feed mechanism. The roof of the vessel, in some examples, has vertical outlet ports that include intrusions into the interior volume of the reactor proximate the conical wall of the top section. The configurations of outlet ports with intrusions and the configurations of feed ports for more uniform distribution of feed material are also applicable to reactor vessels with other geometries.

19 Claims, 6 Drawing Sheets

(56) References Cited

U.S. PATENT DOCUMENTS

| | | | | | |
|---|---|---|---|---|---|
| 3,217,056 | A | | 11/1965 | Sennewald et al. | |
| 3,476,650 | A | | 11/1969 | Peacock | |
| 3,602,362 | A | | 8/1971 | Jacobson | |
| 4,013,415 | A | * | 3/1977 | Burov et al. | 422/186 |
| 4,197,092 | A | | 4/1980 | Bretz | |
| 4,200,438 | A | | 4/1980 | Kaimann et al. | |
| 4,761,793 | A | | 8/1988 | Dighe et al. | |
| 4,844,737 | A | * | 7/1989 | Oono et al. | 75/460 |
| 4,998,486 | A | | 3/1991 | Dighe et al. | |
| 5,544,597 | A | | 8/1996 | Camacho | |
| 5,548,611 | A | * | 8/1996 | Cusick et al. | 373/18 |
| 5,597,541 | A | * | 1/1997 | Tang | 423/244.01 |
| 5,634,414 | A | | 6/1997 | Camacho | |
| 5,728,193 | A | | 3/1998 | Dighe et al. | |
| 6,005,149 | A | * | 12/1999 | Bishop | 585/241 |
| 6,155,182 | A | * | 12/2000 | Tsangaris et al. | 110/255 |
| 6,719,952 | B1 | | 4/2004 | Yang et al. | |
| 6,987,792 | B2 | | 1/2006 | Do et al. | |
| 7,452,392 | B2 | * | 11/2008 | Nick et al. | 48/198.1 |
| 2002/0159929 | A1 | * | 10/2002 | Kaneko et al. | 422/190 |
| 2006/0086698 | A1 | | 4/2006 | Jackson | |
| 2007/0266633 | A1 | * | 11/2007 | Tsangaris et al. | 48/127.9 |
| 2007/0266634 | A1 | | 11/2007 | Tsangaris et al. | |
| 2008/0299019 | A1 | | 12/2008 | Dighe et al. | |

OTHER PUBLICATIONS

U.S. Appl. No. 12/157,751, filed Jun. 14, 2008, Dighe et al.

Westinghouse Plasma Corporation, "Industrial Plasma Torch Systems," Descriptive Bulletin 27-501, published by approximately 2005, pp. 1-15.

Dighe, Proceedings of NAWTEC 16, May 19-21, 2008 (Extended Abstract #NAWTEC16-1938), "Plasma Gasification: A Proven Technology".

Willerton, Proceedings of 27th Annual International Conference on Thermal Treatment Technologies, May 12-16, 2008, A&W Mgt. Assoc. (14 pages).

* cited by examiner

PLASMA GASIFICATION REACTOR

FIELD OF THE INVENTION

The invention relates to plasma gasification reactors with features that can facilitate processes such as syngas production particularly including reactor feed port configurations in combination with other aspects of plasma gasification reactors and systems in which they are used.

COMPANION APPLICATIONS

The present application is related in subject matter to commonly assigned Ser. Nos. 12/378,467 and 12/378,166 being filed on the same date as the present application. The three applications disclose reactor vessel features and combinations including reactor vessel geometries, outlet port (or exhaust port) configurations, and material feed port configurations also subject to independent utility.

BACKGROUND

This background is presented to give a brief description of the general context of the invention.

Plasma gasification reactors (sometimes referred to as PGRs) are known and used for treatment of any of a wide range of materials including, for example, scrap metal, hazardous waste, other municipal or industrial waste and landfill material to derive useful material, e.g., metals, or to vitrify undesirable waste for easier disposition. Interest in such applications continues. (In the present description "plasma gasification reactor" and "PGR" are intended to refer to reactors of the same general type whether applied for gasification or vitrification, or both.)

Along with the above-mentioned uses, PGRs are also adaptable for fuel reforming or generating gasified reaction products that have applicability as fuels, with or without subsequent treatment.

PGRs and their various uses are described, for example, in *Industrial Plasma Torch Systems*, Westinghouse Plasma Corporation, Descriptive Bulletin 27-501, published in or by 2005; a paper by Dighe in Proceedings of NAWTEC16, May 19-21, 2008, (Extended Abstract #NAWTEC16-1938) entitled "Plasma Gasification: A Proven Technology"; a paper of Willerton, Proceedings of the 27$^{th}$ Annual International Conference on Thermal Treatment Technologies, May 12-16, 2008, sponsored by Air & Waste Management Association entitled "Plasma Gasification—Proven and Environmentally Responsible" (2008); a U.S. patent application of Dighe et al., 2008/0299019, published Dec. 4, 2008, entitled "System and Process for Upgrading Heavy Hydrocarbons"; a U.S. patent application of Dighe et al., Ser. No. 12/157,751, filed Jun. 14, 2008, entitled "System and Process for Reduction of Greenhouse Gas and Conversion of Biomass", all of said documents being incorporated by reference herein for their descriptions of PGRs and their uses.

SUMMARY

This summary briefly characterizes some aspects of the invention. Statements made are intended to be generally informative although not as definitive as the appended claims.

The present invention is, in part, directed to a PGR particularly, but not limited to, one applied primarily as a gasifier capable of producing a synthesized gas (or "syngas") that may be useful as a fuel, that is characterized, in a vessel of a vertical configuration, by having a bottom section, a top section, and a roof over the top section with certain geometric and structural characteristics. In some disclosed embodiments the bottom section, which may be cylindrical, contains a carbonaceous bed into which one or more plasma torches inject a plasma gas to create an operating temperature of at least about 600° C. (and typically up to about 2000° C.), and the top section extends upward from the bottom section as a conical wall, substantially continuously without any large cylindrical or other configured portions, to the roof of the vessel, the conical wall being inversely oriented, i.e., its narrowest cross-section diameter being at the bottom where it is joined with the bottom section, and is sometimes referred to herein as having the form of a truncated inverse cone.

Although some previously disclosed PGR configurations have top sections that are enlarged between the lower end of the top section and the upper end of the top section, the presently disclosed embodiments of PGRs are not previously known.

Such example embodiments may further include in their overall combination innovative arrangements of one or more feed ports for introduction of feed stock into the reactor vessel that can contribute to more uniform distribution of material. Such distributive feed port configurations are also applicable to PGRs with other vessel geometries.

Also, in further examples with the conical wall, there are one or more outlet ports each having a duct extending from the roof to the exterior of the vessel and also extending, by an intrusion, into the interior of the vessel. Such outlet ports with intrusions can also be applied in other locations and vessel geometries of PGRs.

These and other aspects of PGRs can be selectively applied, along with the referred to conical wall, for any of the general purposes of PGRs, particularly including, but not limited to, that of producing a syngas useful for fuel applications after exiting the vessel through the outlet ports. Some disclosed examples take advantage of an improved understanding of how reactor structural features can affect characteristics such as gas flow and residence time of reactants that can contribute to achieving more complete reactions of supplied materials for enhanced production of desired output products.

The following description presents more aspects and information about example embodiments of the invention.

FURTHER DESCRIPTION OF EXAMPLES

Figure 1:
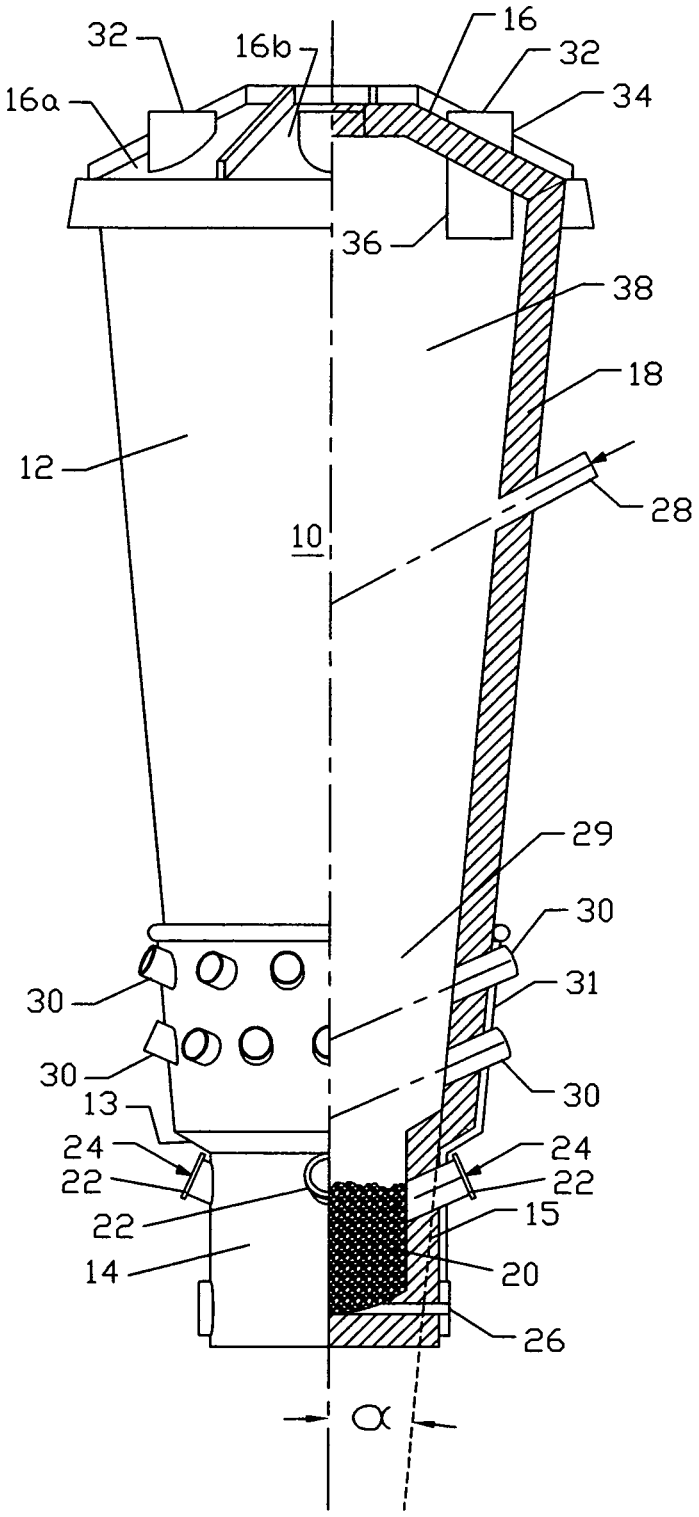
FIG. 1 is an elevation view, partly in section, of one example of a plasma gasification reactor in accordance with the invention.

FIG. 1 illustrates an example PGR, such as for gasification of carbonaceous and non-carbonaceous feed material (e.g., a mixture of coal and biomass) to produce a syngas, slag and metals. "Syngas" is a term referring to "synthesis gas" generally derived from a feed material, including carbon material (e.g., coal) or hydrocarbon material (e.g., biomass or heavy oils), subjected to gasification with oxygen (e.g., from air) and water (e.g., steam). The resulting syngas typically contains hydrogen and carbon monoxide that can be useful. Additionally, depending on the solid and gaseous materials supplied, quantities of vaporized hydrocarbons may occur in the syngas. The syngas produced may be applied to use as a fuel, for example fueling a gas turbine, or further processed to form a liquid fuel, e.g., ethanol, for transportation purposes. A PGR such as that of FIG. 1 may also be applied to purposes, such as metal salvage, where gaseous products are exhausted with or without subsequent treatment.

The reactor of FIG. 1, shown in full elevation in its left half and vertically sectioned in its right half, has a reactor vessel 10, generally of refractory-lined steel (the lining not being specifically shown in the drawing), whose prominent parts include a top section 12, a bottom section 14, and a roof 16. The top section 12 has its lower and upper ends joined, respectively, to the bottom section 14 and the roof 16 in a gas tight manner. One aspect of particular interest in the FIG. 1 embodiment is that the top section 12 has a conical wall 18 from the bottom section 14 (smaller cross-section) to the roof 16 (larger cross-section). The wall 18 has an angle ($\alpha$, in FIG. 1) relative to the vertical axis of the reactor vessel 10 (e.g., an angle in the range of about 5° to about 25°) over substantially its entire extent. This is one example of a configuration that can aid operational gas flow (discussed further below). However, useful configurations and benefit can also be obtained if there are minor variations, such as a wall like the wall 18 but having a variation in its conical slope anywhere along its extent to a larger angle relative to vertical as one proceeds up the wall 18, or to a lesser angle, by a change of no more than about 5°, or where the wall includes, for whatever reason, a minor portion, no more than about 10% to 20% of its total length, of variant or non-conical (such as cylindrical) form (where the use of up to about 20% of the total length in cylindrical form can be particularly useful for the location of feed ports as will be explained further in reference to FIG. 6.).

Figure 2:
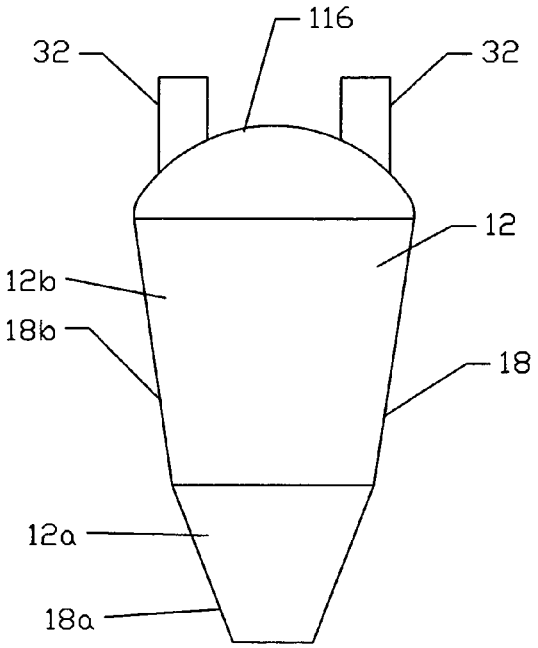
FIGS. 2 and 3 are outline elevation views of other example PGRs.
Figure 3:
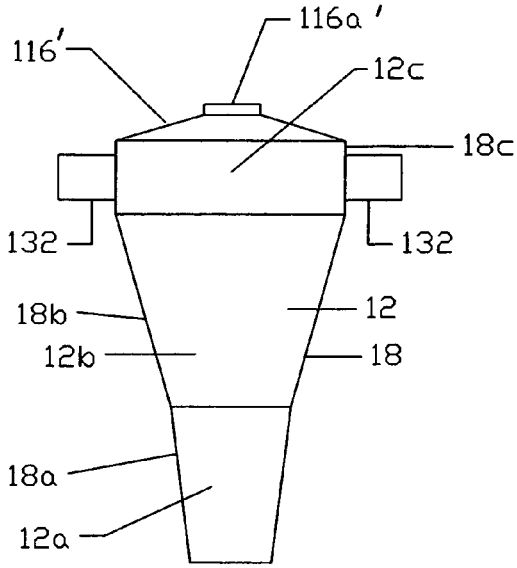

FIGS. 2 and 3 illustrate embodiments in which a lower portion of the top section 12*a* has a conical wall portion 18*a* at a slightly different angle than the conical wall portion 18*b* of an upper portion of the top section 12*b*, as examples of other suitable innovative arrangements. In FIG. 2, the wall 18*a* of the lower portion 12*a* is angled out more then wall 18*b* of the upper portion 12. In FIG. 3, the variation is that wall 18*b* is angled out more than wall 18*a*. Other aspects of FIGS. 2 and 3 will be discussed below.

Returning to FIG. 1, the bottom section 14 of the reactor vessel 10 example can be of any convenient configuration and is generally cylindrical. It fits directly with the circular bottom of the top section 12, however with a minor conical transition 13 with a greater angle than most of the wall 18. Thus, the top of the bottom section 14 and the bottom of the top section 12, have like configurations or have a transition of minor extent therebetween.

It is generally convenient for the top section 12 and its substantially conical wall 18 to have a circular cross-section at horizontal levels over the vertical extent of the vessel. Another variation is where the lateral cross-section of the top section 12 is not circular; for example an oval cross-section with orthogonal lateral dimensions having a ratio in a range greater than 1 to 1, including those up to about 3 to 1, is suitable. Any example described may have a circular or non-circular cross-sectional configuration, as well as the other described aspects of PGRs.

To summarize the geometrical characteristics of a wall 18 as shown in FIG. 1 and, also, as subject to some variations in other examples of PGRs:

the wall 18, or at least about 80% to 90% of it, has a slope relative to the vertical axis at an angle $\alpha$ that is between about 5° and about 25°;

the wall angle $\alpha$ is either the same overall or is increasingly wider as one proceeds up from the bottom section 14 to the roof 16 or, in examples in which a becomes less, i.e., there is a transition from a larger a to a smaller a as one proceeds vertically up, any such transition is no more than about 5° of angle and the upper part still has an a greater than zero;

the conical wall 18 can have either a circular cross-section (the most typical case) or some other including an oval cross-section, such as up to a ratio of about 3:1 in two orthogonal diameters; and any parts of a side wall of a PGR top section 12, from a bottom section 14 to a roof 16 that do not meet any of the above criteria, e.g., a cylindrical wall with zero angle to vertical, is limited to no more than about 10% of the vertical height of the top section, except where a cylindrical wall portion is provided with one or more lateral feed ports it may occupy up to about 20% of the vertical height of the top section.

Even with such possible modifications, all of which are to be considered within the scope of the invention as a "conical top section" or "conical wall", or "continuous conical wall", whether or not the term "substantially", or the like, accompanies them, the conical wall 18 contrasts with prior PGR vessel configurations, e.g., those with substantial (at least about 25%) cylindrical portions or conical portions that are wider at bottom than top.

The upper section wall geometry referred to herein is the geometry of the interior surface of a wall such as wall 18 in FIG. 1. Typically, the outer surface of a top section wall is parallel with the inner surface but that is not essential to meet the criteria of interest.

Additional features of the bottom section 14 and their purposes are as follows for this typical example. The bottom section 14 contains a space for a carbonaceous bed 20 (sometimes referred to as the carbon bed or the coke bed) that can be of constituents such as fragmented foundry coke, petroleum coke, or mixed coal and coke. By way of further example, the bed 20 can be of particles or fragments of the mentioned constituents with average cross-sectional dimensions of about 5-10 cm, or are otherwise sized and shaped to have ample reactive surface area while allowing flow through the bed 20 of supplied materials and reaction products, all generally in accordance with past PGR practices.

The bottom section 14 has a wall 15 with one or more (typically two to four) nozzles, ports or tuyeres 22 (alternative terms) for location of a like number of plasma torches 24 (not shown in detail). The plasma ports 22 may be either at an angle to the horizontal, inclined downward, as shown, or otherwise, such as horizontal (which is also the general case for feed ports 28 and additional tuyeres 30 of the top section 12 discussed below).

The bottom section 14 is also equipped with a number (one or more; typically one or two) of molten liquid outlets 26 for removal from the reactor of metal and/or slag.

Returning now to further describe aspects of the top section 12, the conical wall 18 is provided with a number (at least one; typically one to three) of lateral (i.e., through the wall 18) feed ports 28. Lateral feed ports 28 make it generally unnecessary to have any feed port through the roof 16 although that form is not excluded as either an addition or an alternative. The lateral feed ports 28 allow entry of feed material close to the primary reaction region of the reactor and can lessen the chance of unreacted feed material being blown out through outlet ports in or near the roof. Subsequent description of FIGS. 5-8 below includes discussion of ways of getting substantially uniform distribution of material as well as thoroughness of reactions. In accordance with one example, described further in connection with FIG. 8, a feed port is equipped with a distributive feed mechanism to help get more uniform distribution of feed material over the interior of the reactor's top section.

Additionally, the top section 12 of FIG. 1 has a number of tuyeres 30 (e.g., up to about a dozen in each of two rows) for use as needed or desired in any particular process that is performed to supply additional, generally gaseous, material. The tuyeres 30 are, in this example, located through the conical wall 18 below the feed ports 28 and proximate the bottom section 14. The plasma ports 22 of the bottom section 14 are sometimes referred to as primary tuyeres while the tuyeres 30 of the top section 12 are sometimes referred to as secondary tuyeres (those in a row closest to the bottom section 14) and tertiary tuyeres (in a row above the second tuyeres).

The roof 16 covers the upper end of the conical wall 18 of the top section 12. The perimeter of the upper end of the wall 18 is sealed in a gas-tight relation to the roof 16. The roof 16 has a number, one or more, typically two to six, of outlet ports 32. The outlet ports 32 constitute ducts for exit of gaseous products (e.g., syngas) from the reactor vessel 10. In some examples of a PGR of the invention, as in FIG. 1, outlet ports 32 are only through the roof 16 of the reactor vessel 10 and feed ports 28 are only through the conical side wall 18.

In the example of FIG. 1, the outlet ports 32 extend directly vertically through the roof 16. Among alternative arrangements, roof outlet ports, of whatever number, can be arranged with their axes at an angle to the vertical; one example being to have the axis of an outlet port at an angle substantially the same as the angle of the wall 18 and parallel with the wall 18. More generally, the axis of outlet ports through the roof may be at any angle and in some instances be other than as shown through the roof 16, such as laterally through the upper periphery of the wall 18 itself, such as in FIG. 3, while the roof of the vessel has either none or also has one or more outlets. Typically, a manway with a removable cover is also provided in the roof 16.

In some examples of interest, as in FIG. 1, the outlet ports 32 are located in the roof 16 proximate the inner surface of the wall 18. In whatever configuration of the outlet ports is utilized, in terms of their number, size, location and angle, they can be mere openings through the roof (or wall) of the vessel 10, with suitable external ductwork, or, as shown in FIG. 1, the outlet ports 32 can be arranged with ducts 34 passing to the exterior of the vessel 10 from a location inside of the vessel 10. The inner part of the ducts 34 is referred to as an intrusion or intruding port 36. The intrusions 36, in some examples as shown in FIG. 1, extend into the space proximate the inner side of the side wall 18 of the top section 12.

FIG. 1 and the above description including various modifications provide examples of PGRs each utilizing a top section 12 with a substantially continuous conical wall 18, as described, in contrast to prior known PGRs of comparable parts and purposes that have, in one or more sections above that which contains a carbonaceous bed, a significant part of cylindrical or other configuration.

Practitioners can utilize and take advantage of a substantially continuous conical wall 18 in PGRs of otherwise conventional configuration, for example, with normal gravity fed feed ports and outlet ports anywhere near the top of the vessel and without an intrusion. Also, a continuous conical wall 18 can be part of overall altered PGR designs including, for example, one or more feed ports having means for enhanced distribution of feed material as well as one or more outlet ports having a duct with an intrusion, as described above.

In FIG. 2, outlet ports 32 are shown through a roof 116. Here the roof 116 is domed shaped.

In FIG. 3, a variation is shown with outlet ports 132 extending laterally from an extreme top portion 12*c* of the top section that also, in this example, is shown with a cylindrical configuration of a minor extent that still keeps an overall substantially conical configuration for the wall 18. Alternatively, the conical shape of the wall 18 itself may continue up and the lateral outlet ports 132 provided through it.

FIG. 3 can be an example of outlet ports 132 without an inner intrusion, although intrusions can suitably be used there as well. FIGS. 2 and 3 for simplicity do not illustrate feed ports except the top central feature 116*a*' in the roof 116' of FIG. 3 can represent either a central gravity fed feed port or a manway. Feed ports and tuyeres in the top section and the entire bottom section of the reactors in FIGS. 2 and 3 are omitted for simplicity. They may, for example, be configured substantially as described in connection with FIG. 1 or the other examples herein.

PGR outlet ports with intrusions, like outlet ports 32 having ducts 34 with intrusions 36 of FIG. 1, are not limited to use in PGRs with a substantially conical wall, such as the wall 18. Favorable use of such outlet ports can be made with other side wall geometries, as well as in other locations than the specific examples shown.

The following is presented by way of further explanation and example of factors influencing the conical top section design configurations.

The arrangements disclosed have particular relevance in their application to vertically oriented, atmospheric gasifier vessels. These are gasifier vessels for operation at or near atmospheric pressure (i.e., operable in a range from slightly negative pressure to slightly positive pressure) that are subjected to flow of gases and gas borne solid elements, with high temperatures, throughout their operation. It can be important how reactor configurations affect the movement of gases and particles in a freeboard region 38 of the reactor 10, as in FIG. 1.

The interior of the top section 12 can be considered to contain two principal regions. A gasification region 29 is the region at or proximate the tuyeres 30 in which supplied material is (at least partially) gasified. (A water jacket 31 can be used as desired to moderate wall temperature.) The freeboard region 38 is the space in the top section 12 above the tuyeres 30 through which gasified materials ascend. Studies by computational fluid dynamics can model heat transfer and fluid flow for the gasifier vessel in the freeboard region 38 to help achieve improved performance. Alternative designs can be evaluated based on a number of criteria such as the velocity flow field, the gas residence time distribution and the solids carryover to an outlet. Such studies can demonstrate how a benefit can be attained by having a conical expansion, as described above, for the wall 18. One characteristic attainable is that of minimizing the flow separation from the reactor wall and minimizing low velocity recirculation zones created as a result of the flow separation. It is of incidental benefit to be able in some cases to achieve lower cost for both the steel required for the vessel and its refractory lining by the relative simplicity of the conical wall 18.

Regarding the velocity flow field, it is considered that the reactor cross-sectional velocity is better if it is more uniform as that leads to more efficient use of the reactor volume for the reactions performed.

The gas residence time distribution profile indicates the average gas residence time. A longer time is generally better for more consistent composition of products at the reactor outlets. Also, feed materials need a high enough temperature for a sufficiently long time for more thorough reaction, i.e., so an undesirable amount of unreacted feed material does not exit the reactor. This can be of particular importance with some heavy materials such as tar. A generally desirable characteristic is for the reactor to perform substantially like a plug flow reactor which means input solid materials descend mainly vertically and output gases ascend mainly vertically.

Consequently, the gas generated within the reactor should have at least a minimum residence time of sufficient length to achieve satisfactory performance.

Based on the above considerations, it is the case that performance of a reactor in which there is a conical top section wall, such as wall 18, (including the described minor variations) is often better than one having a cylindrical or other configuration for any more significant portion of the top section 12.

In addition, whether used with a top section conical wall or with a conventional top section of some significant cylindricality, the configuration of outlet ports can make a significant difference in the carry-over velocity as well as the residence time.

The solids carry over is mainly a function of the axial velocity along the main flow path apart from the solid physical properties. The average axial velocity along the main gas flow path to the outlets is termed the "carry-over velocity". It is desirable to have the carry-over velocity as low as possible to minimize the solids carryover.

Figure 4:
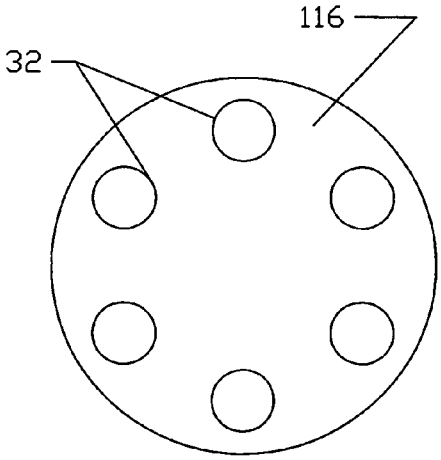
FIG. 4 is a plan view of the top roof of a PGR in accordance with an example of the invention.

Various outlet configurations have been evaluated. It is found generally that better flow and efficiency characteristics result if there are two or more individual outlets, e.g., at least four. By way of further example, six outlets, as shown in FIG. 4, can be one effective arrangement. Here is shown a domed roof 116 of a reactor vessel with six outlet ports 32 uniformly arranged about, or near, the outer periphery of the roof 116, without any more centrally disposed outlets. For combination with a circular top of a conical wall 18, the roof 116 can be circular. The outlet ports 32 may be circular in cross-section, as shown, or have some other cross-section. With any number of outlet ports 32 provided through the roof 116, it is generally suitable to have them located proximate the periphery of the roof 116.

A PGR roof can be of various forms including, for example, substantially planar across the top of the top end of the conical wall 18 or, as shown by roof 16 in FIG. 1, projecting upwardly from the top of the wall 18, either with joined roof portions, such as portions 16*a* and 16*b*, that are individually planar, or a continuous bowed out curved surface as shown by roof 116 in FIGS. 2 and 4.

The individual outlet ports 32, of whatever number or location, can usefully include in their ductwork an intrusion, similar to the intrusions 36 of FIG. 1. The intrusions can, for example, extend about 0.5-1.0 m. from the roof into the vessel (i.e., from the interior surface of the roof). These have been found, at least in some analyses, to contribute to stability of gas flow from the outlets.

The additional tuyeres 30 of FIG. 1 include a row of secondary tuyeres and a row of tertiary tuyeres. The secondary tuyeres typically number about twelve in a row below, nearer the coke bed 20, than a row of a similar (or larger) number of the tertiary tuyeres. The tuyeres 30 are used to admit materials, usually gaseous materials such as air (or other oxygen containing gas) and steam (or other water). Particulate solids can also be introduced through the tuyeres 30. Embodiments like FIG. 2 or 3 can have similarly arranged additional tuyeres, which are emitted from those figures for simplicity.

In some process operations it can be satisfactory for feed material to be supplied merely through an opening through the roof of a reactor but it can be more generally helpful to enhance the residence time of solids by only supplying feed material through lateral feed chutes such as feed port 28 through a side wall, such as 18. One or more of such feed chutes, with other wall arrangements, are included in prior examples of PGRs. Further innovations can include some means for more uniform distribution of feed material into the top section of the reactor as is more fully described in connection with FIGS. 5-8. For example, and without limitation, one may get reasonably uniform feed material distribution if a feed chute (even where just one is used) is angled down from the horizontal, such as the feed port 28 shown in FIG. 1. Also, in combination with such an angled chute or independently, it can help to have a distributive feed mechanism within a feed chute. Variations can include mechanisms that can be programmed or adjusted to vary the force applied to the feed material (to achieve variations in the distance it is injected, for example, in a radial inward direction) and/or to vary the angle or direction from the feed chute that the material is injected. FIG. 8 further illustrates this aspect.

The following supplemental information refers to some other aspects of embodiments the invention may take.

Plasma torches 24 that may be applied in the plasma torch ports 22 in FIG. 1 may be in accordance with prior practice such as that shown and described in U.S. Pat. No. 4,761,793 by Dighe et al. that is hereby incorporated by reference for its description of the nature and operation of plasma torches and how they can be applied to a PGR.

PGRs to which the inventive features are applicable can be of a wide range of sizes. Just for example, and similar to some past practices, the total vertical extent of a reactor vessel may be about 10-12 m. and the bottom section, containing the carbon bed, can have a width of about 3-4 m. and a depth of about 1-4 m. The top section can be such as to expand from a bottom diameter like that of the bottom section (about 3-4 m.) to a top diameter, at the roof, of about 7-8 m. Other dimensional examples are given in reference to the description of FIG. 9.

Also by way of example, it is found helpful in various applications to operate so that feed material forms a charge bed on top of the carbon bed that extends up past the height of both of the rows of tuyeres 30 (such as by about 0.5 to 1.0 m.). In regard to the reactor geometry, it may also be noted that reactor vessel 10 can, as examples, be configured to have the secondary tuyeres located about 5-15% of the distance up from the top of the bottom section to the roof, the tertiary tuyeres about 10-30% of that distance up from the top of the bottom section, and the one or more lateral feed chutes at least about 40-60% of the distance up.

FIGS. 5-8 generally illustrate some means for distributive introduction of feed material through ports into the top section 12 of a reactor vessel, such as one having a conical wall 18 although applicable to other configurations as well. It is recognized that having feed material relatively uniformly distributed within the reactor vessel is favorable to uniformity of performance and completion of reaction processes. These are some of the means that can be employed that can result in a better distribution than a single gravity feed port through a lateral wall, such as, but not limited to, the conical wall 18. These are means that also have an advantage over merely dropping material through an opening in the roof, which is a generally workable practice but risks considerable blowing out of unreacted material through nearby outlet ports.

Figure 5:
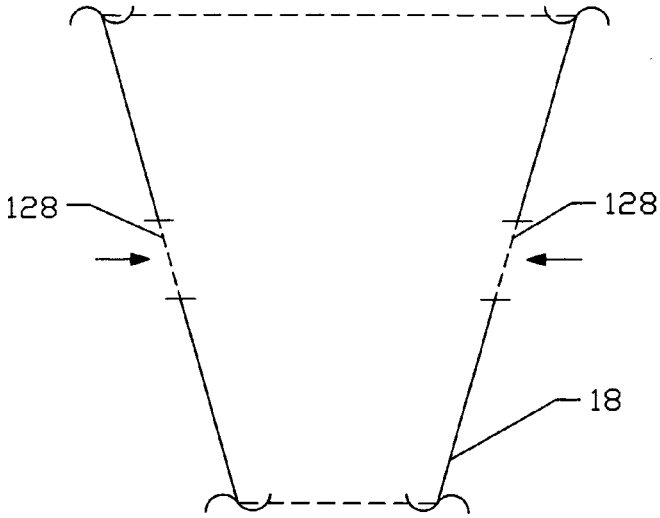
FIGS. 5-8 are partial and schematic views of feed port arrangements that can be applied in some examples of the invention.

FIG. 5 is an example with multiple (here two, typically two to four could be used) feed ports 128 through a wall 18 (just part of which is shown). The feed ports 128 can be merely gravity fed without other distribution enhancements (which could be additionally provided if desired) and the different points of material introduction help to distribute the feed material. It is acknowledged that multiple lateral feed ports have been previously disclosed in plasma rectors, such as in Dighe et al. U.S. Pat. No. 5,728,193 and Do et al. U.S. Pat. No. 5,987,792. Here it is a combination of multiple lateral feed ports 128 and a substantially continuous conical wall 18 of the top section 12 of the reactor that is being disclosed. However, such multiple side entry points for feed material, although generally effective as well as simple to construct, are not the only means for advantageous feed distribution.

Figure 6:
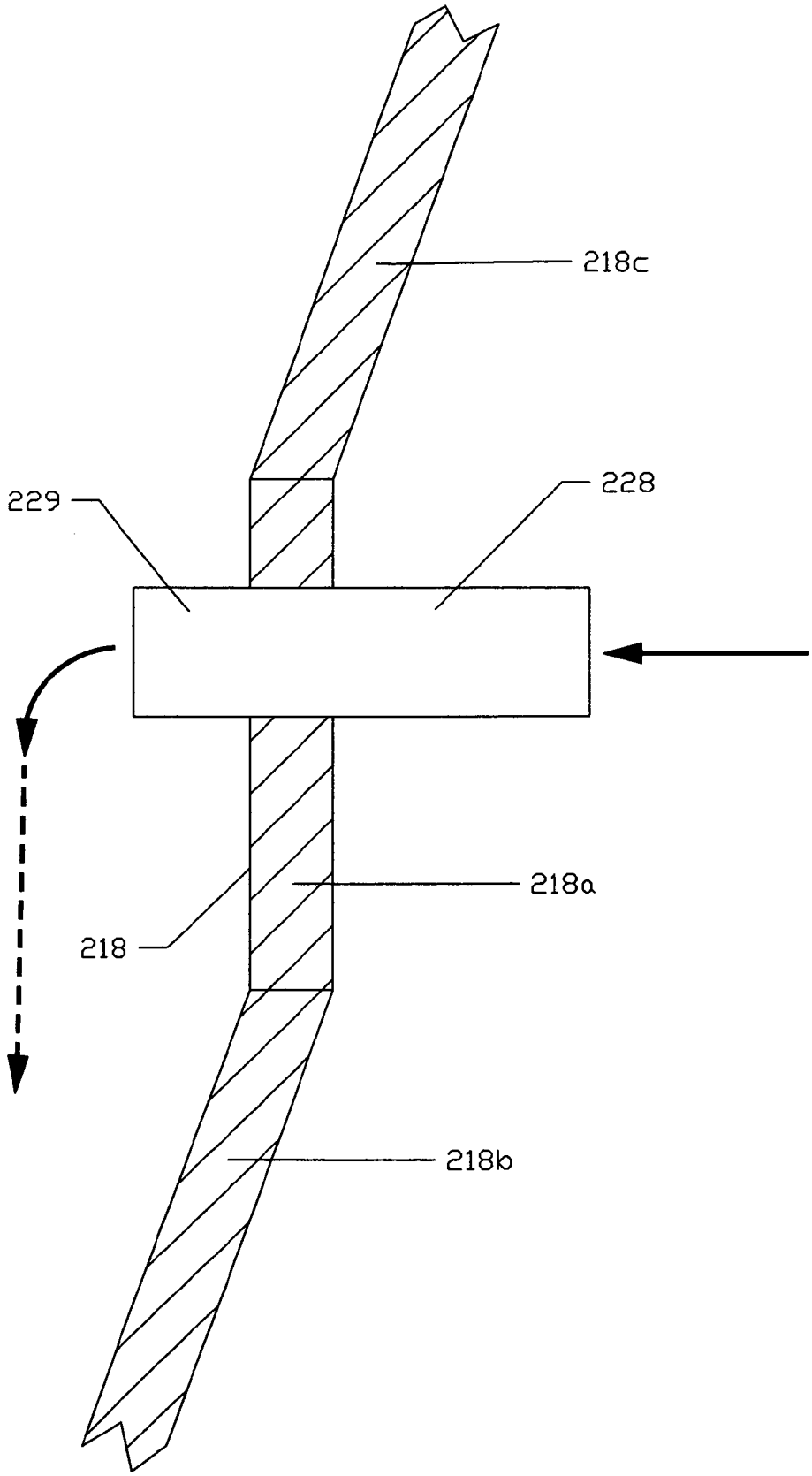
Figure 7:
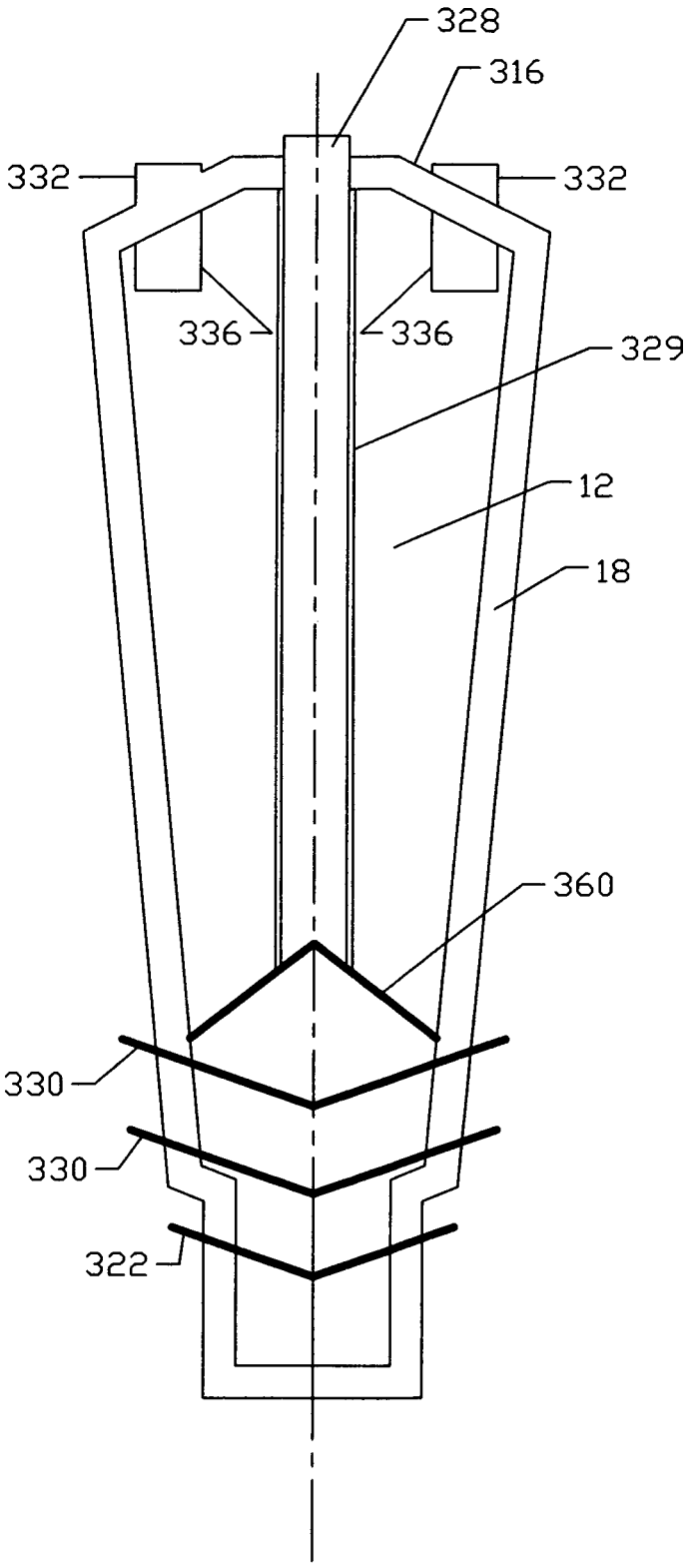
Figure 8:
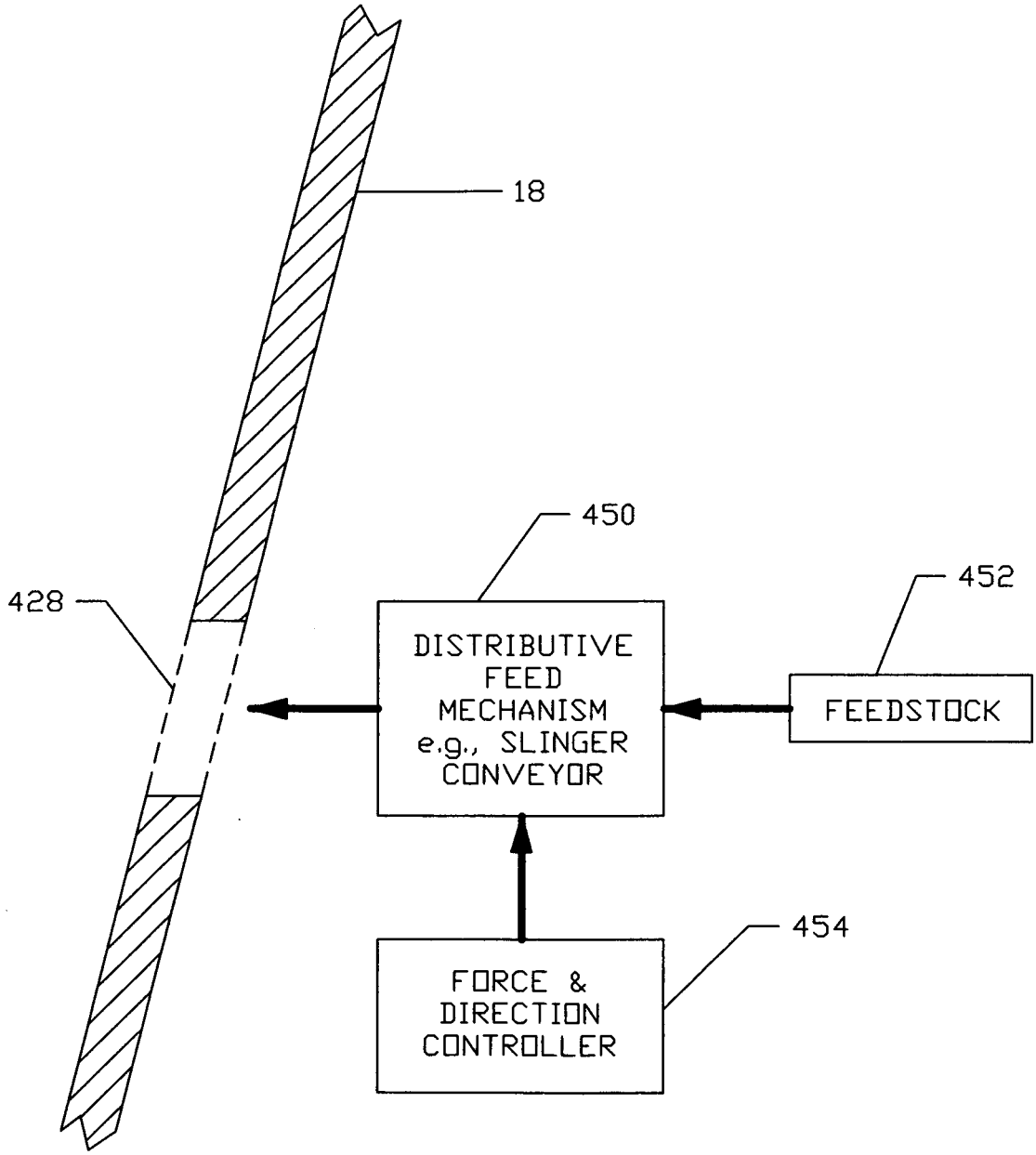

FIGS. 6, 7, and 8 illustrate other means for feed distribution. These are means for feed distribution applicable to use with even only one feed port, although not limited thereto.

In FIG. 6, feed material is supplied through a lateral feed port 228 that has a protrusion 229 (e.g., of refractory lined steel, which additionally may be water cooled) that extends into the vessel toward the vessel's center axis. The protrusion 229 can also be, for example, angled down, such as at angle of about 60°, below horizontal and have an end from which feed material falls nearer to the center axis of the vessel 10 than to the side wall which in this example is a substantially conical wall 218 which includes a cylindrical section 218*a* (of no more than about 20% of the top section's height). Feed material will descend by gravity to the central region of the lower part of the reactor roughly along the dashed line trajectory shown. Such a feed port 228 and protrusion 229 through a side wall can be applied to other wall configurations as well.

Among the notable points about the particular example of FIG. 6, and referring back to FIG. 1, are that a protrusion 229 can be chosen to extend any desired distance into the reactor vessel's top section 12 from the conical wall 18. It can extend further toward the center of the vessel where it is intended to form a more uniform charge bed or where it is intended to further minimize the impact of feed material on the inner surface of the wall 18, that typically has a layer of refractory material.

Furthermore, even with a very limited protrusion 229, or even no protrusion of the feed port beyond the wall 18 into the vessel, FIG. 6 shows an example of a configuration of the wall 218 that can help minimize wear on the inner wall surface below the feed chute 228. In this embodiment, the wall 218 has outwardly extending, conical portions 218*b* and 218*c* with the feed port 228 located on the cylindrical wall portion 218*a* between portions 218*b* and 217*c*. The cylindrical wall portion 218*a* extends below the feed port 228 before it meets the conical wall portion 218*b*. That means, in contrast to FIG. 1, material entering the vessel from the feed port 228 does not immediately descend onto the inner surface of a conical wall. Here, in FIG. 6, the material from the feed port 228 generally takes an arcurate path and scatters to some extent so the impact on an inner wall surface 218*b* is minimized and its wear is lessened.

FIG. 7 shows an alternative in which a feed port 328 is at least proximate the center of the roof 316 and has a protrusion 329, similar in form to protrusion 229 of FIG. 6 but here extending vertically down well into the top section 12, i.e., so material enters well below the outlet ports 332, which is also the case in FIG. 6. Thus, the protrusion 329 can, although it need not, extend at least a third of the way down through the top section 12 at or near the center axis. Naturally a feed port protrusion, such as 229 or 329, requires structural strength and/or cooling adequate for its exposure to high temperature.

FIG. 7 shows an outline 360 of the approximate maximum extent of any build up of feed material on a charge bed in the reactor. Lines 322 and 330 in FIG. 7 are shown as representative indications of the location of primary and additional tuyeres of the example reactors. The FIG. 7 embodiment can place feed material centrally on the charge bed. Outlet ports 332 with intrusions 336 are also shown in the example of FIG. 7.

FIG. 8 shows another means for feed distribution. A feed port 428 in a lateral wall 18 is arranged with a distributive feed mechanism 450 that has feedstock supplied to it from a supply 452 and by mechanical force injects or throws the material into the interior of the vessel.

The distributive feed mechanism 450 arranged in the combination can be like or similar to mechanisms heretofore applied for forced distribution of materials in apparatus applied in fields such as agriculture and mining. One such mechanism is that commonly referred to as a slinger conveyor. Other mechanisms can be used; for present purposes a distributive feed mechanism can be any that applies mechanical force to the feed material. An air blower is one other such apparatus but is best used where the feed stock has a substantial amount of matter that is roughly consistent in size and weight.

FIG. 8 additionally shows, as an option in combination with the distributive feed mechanism 450, a force and direction controller 454, that can do either or both of two things: the controller 454 can be arranged so the feed mechanism 450 applies varying magnitudes of force to feed material to provide, over time, even better distribution than with constant force. Also, the controller 454 can be arranged so the feed mechanism 450 applies force at varying angles (e.g., by a range of movement of the mechanism 450), either, or both, in a horizontal plane or vertically, for better distribution than if material continuously enters at the same angle. The particular mechanism 450 and controller 454 can be adapted from material handling equipment technology used in other contexts.

The means disclosed in FIGS. 6-8 are each shown applied to only a single feed port of the reactor vessel. That is generally satisfactory but other numbers of such means, or combinations of such means, could be employed. It should also be understood that the arrangements for feed ports with enhanced distribution of feed material as shown in FIGS. 6, 7, and 8 are not necessarily limited to use with a reactor having a top section with a substantially conical wall, although such a wall may be often preferred.

In the case of any of the feed ports described herein, they can either be open to admission of air along with feedstock, such as under normal atmospheric conditions, or the feed supply and feed ports can be restricted to limit air admission, which can sometimes be favorable for some reactions.

Figure 9:
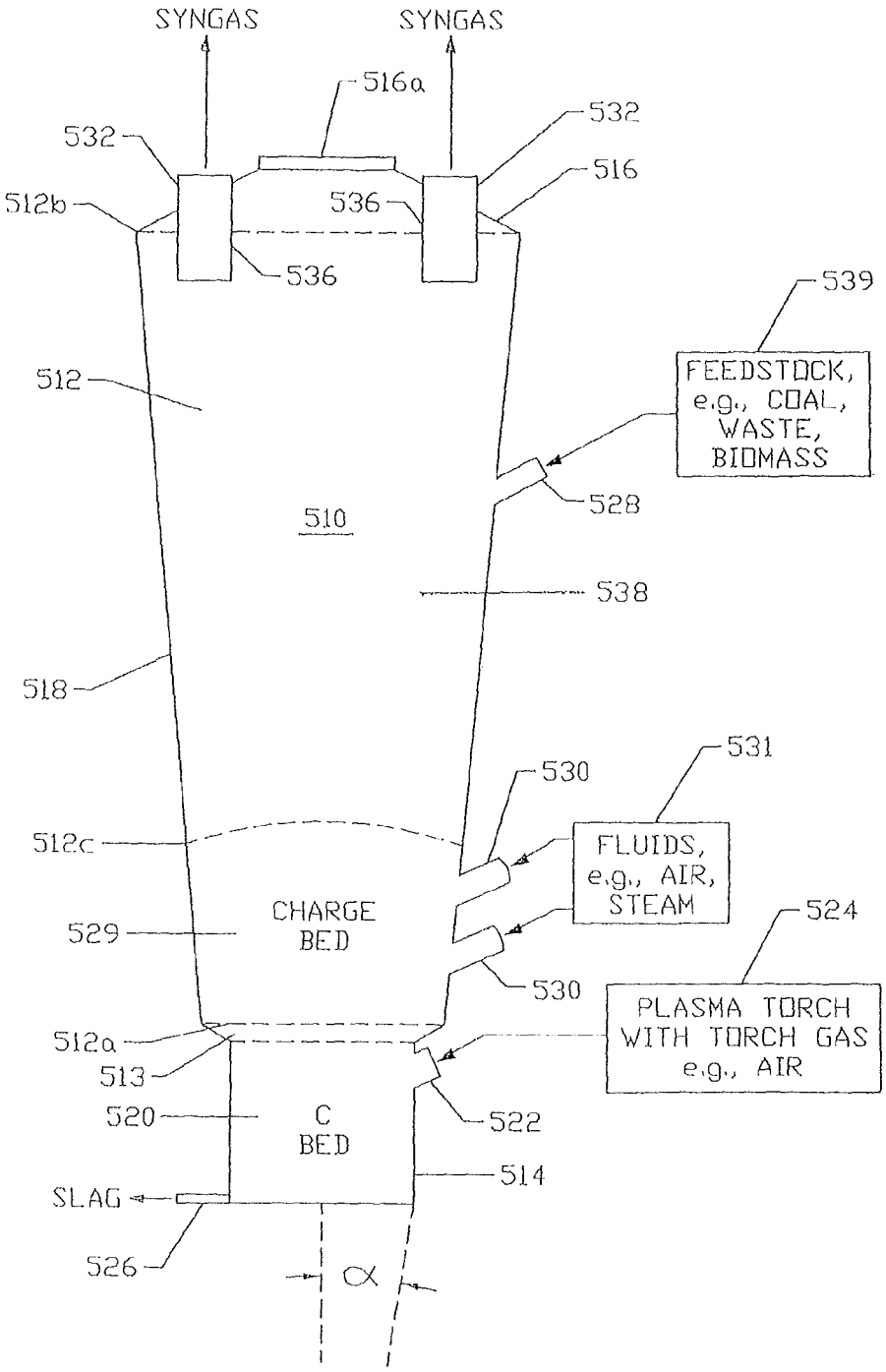
FIG. 9 is an outline schematic view of a PGR system in accordance with an example of the invention.

FIG. 9 shows an example of a system in accordance with the invention, in outline and schematic form, that includes a plasma gasification reactor vessel 510 in a form as previously described, and subject to variations such as those previously described.

Merely by way of further example, some examples of suitable, approximate, dimensions for some elements of the vessel 510 are given. Unless otherwise made clear, the dimensions given refer to internal dimensions only. The vessel 510 is not shown with a wall thickness but the wall could typically be in a range of about 0.3-0.6 m., including steel and refractory material. A top section 512 of the vessel 510, within a conical wall 518, can have a cross-sectional diameter at a bottom level 512*a* (above a transition 513 between the bottom section 514 and this top section 512) of about 3.5 to 4.5 m. and a cross-sectional diameter at a top level 512*b* of about 7 to 8 m., resulting in an angle $\alpha$ of about 12°. At a level 512*c*, proximate and slightly above some auxiliary tuyeres 530

(which may be in two levels of secondary and tertiary tuyeres as previously disclosed), the cross-sectional diameter of the vessel can be about 4 to 5 m. and this would be the approximate diameter of the top surface of a charge bed 529 of feed stock fed into the vessel from a feed port 528, subject to all the prior descriptions of examples of feed ports, which can be one or more in number.

FIG. 9 does not intend to show a particular configuration for the top surface of the charge bed 529; it need not be level, although approximate levelness is favorable, and it typically is somewhat higher in one or more locations that are closer to (e.g., directly under) any gravity fed feed ports that the reactor has which do not have a distributive feed mechanism.

The overall height of the top section 512, from level 512*a* to level 512*b* can be about 11 to 13 m.; the charge bed 529 can have a height between the levels 512*a* and 512*c* of about 2 to 3 m.

The vessel 510 also has a bottom section 514. It can have a cylindrical diameter of about 1 to 2 m. and a height of about 3 to 4 m. The bottom section 514 contains a bed 520 (labeled C bed) of carbonaceous material as described in connection with FIG. 1.

The bottom section 520 is here shown with a plasma torch nozzle or primary tuyere 522 for a plasma torch 524 injecting a plasma gas into the bed 520 that creates a suitably high temperature in the bed 520. As shown, the torch 524 is supplied with a torch gas, conveniently air but other gases and gas mixtures are suitable as well. The plasma torch in any of the embodiments may have an additional supply (not shown) of material such as steam, oil, or another material reactive in the bed 520 with the torch gas. The additional material can be supplied to the nozzle 522 in front of the plasma generating torch 524 or a region of the C bed 520 proximate the location of the nozzle 522. Reference is made to the above-mentioned U.S. Pat. No. 4,761,793 for further understanding of examples of plasma torch nozzles that may be applied in systems such as that of FIG. 9 and which have a shroud gas applied around the plasma plume of a torch.

The C bed 520 need not fill the bottom section 514 of the reactor 510 to the top of section 514; the charge bed 524 can extend part way within the top of section 514.

FIG. 9 also shows an outlet 526 for molten metals and slag from the bottom of the C bed 520.

The secondary and tertiary tuyeres 530 that supply the charge bed 529 in the gasification region of the reactor are shown connected with a supply 531 (which is representative of one or more supplies of the same or different materials) that is shown, for example, as introducing one or more fluids such as air or steam into the charge bed 529.

The charge bed 524 is formed of material fed into the vessel 510 from a feed port 528 that is shown in conical wall 518 and is merely representative of feed ports as previously described. The feed port 528 is supplied from a feedstock supply 539 supplying, for example, coal or other carbonaceous material, waste which could be municipal solid waste or industrial waste, biomass, which could be any wood or plant material harvested for the purposes of the system or a byproduct of other agricultural activity, or some combination of such materials.

Most of the feedstock descends to the charge bed 524 but some may react with rising hot gases in the freeboard region 538 above the charge bed 529. Also, the rising gases from the charge bed 524 can react further in the freeboard region 538.

Reactions performed in a system like that of FIG. 9 typically include fuel particle surface reactions and gas phase reactions. The fuel particle surface reactions can include a gasification reaction of $$C+\tfrac{1}{2}O_2 \rightarrow CO,$$

a Boudouard reaction of $$C+CO_2 \rightarrow 2CO,$$

and a water gas reaction of $$C+H_2O \rightarrow CO+H_2.$$

The gas phase reactions can include a combustion reaction of $$CO+\tfrac{1}{2}O_2 \rightarrow CO_2,$$

a CO shift reaction of $$CO+H_2O \rightarrow CO_2+H_2,$$

and a steam reforming reaction of $$CH_4+H_2O \rightarrow CO+3H_2.$$

The total reactions result in a syngas formed in the freeboard region 538, particularly in the region above the entry point for material from the feed port 528. The syngas can have significant amounts of carbon monoxide and hydrogen, along with nitrogen from air supplied to the reactor. Lesser amounts of carbon dioxide and other compounds can occur in the syngas.

At the top of the top section 512 of vessel 510 is the roof 516 that has some number of outlet ports 532 from which the syngas exits for subsequent use as fuel or other disposition.

Along with the other dimensional examples given above, the roof 516 covers the maximum width of the top section 512 and also has a raised center about 1 to 2 m. above the top level 512*b* of the top section 512 with sloping surfaces (at, for example, about a 30° angle) therebetween in which the outlet ports 532 occur, near to the conical wall 518. The outlet ports 532 can, for example, have a diameter of about 1 to 1.5 m. with each having an intrusion 536 of about 0.5 to 1 m.

By way of more particular example, a reactor vessel 510 can have four plasma torch ports 522 with plasma torches 524, twelve each of the secondary and tertiary tuyeres 530 and six of the outlet ports 532, with the several elements each being spaced around the circular periphery of the reactor structure, along with one or more feed ports 528.

Accordingly, it can be seen how PGRs can be configured with one or more innovative features. Without limitation as to particular levels of performance, it is believed that among the ways the innovations can be used are ways in which they contribute to overall efficiency in terms of thoroughness of reactions and yields of desirable reaction products.

In some described examples, it is indicated the innovations presented are combined with some aspects of prior PGR practices. Any public knowledge of prior apparatus and practices can be drawn upon as needed to facilitate practice of the innovations presented.

The present application incorporates by reference any content of the copending companion applications identified above for any description of PGRs not contained herein.

In the course of the description various embodiments are presented, along with some variations and modifications, all of which are to be taken as examples of arrangements, but not the sole or exclusive arrangements, practitioners may employ that are within the scope of the claims.

What is claimed is:

1. A plasma gasification reactor comprising:

a vertically oriented reactor vessel including a bottom section and a top section;

the bottom section containing a carbonaceous bed and arranged with one or more plasma torch ports each containing a plasma torch;

the top section extending from the bottom section to a roof over and joined with the top section;

the top section including an upper portion containing a freeboard region and a lower portion containing a gasification region, the lower portion having an interior surface forming an inverse truncated cone with a narrowest cross-sectional diameter located where the top section is joined to the bottom section, a side wall of the upper portion being oriented at a substantially continuous first angle relative to a vertical axis of the vessel, and a side wall of the lower portion including first and second conical portions being oriented at a substantially continuous second angle relative to the vertical axis of the vessel, wherein the second angle is in a range of between about 5° and about 25° with respect to the vertical axis of the vessel;

one or more gas outlet ports from the vessel;

one or more feed ports for supply of feed material into the top section, the one or more feed ports being positioned in a cylindrical portion between the first and second conical portions of the side wall of the lower portion of the top section; and one or more tuyeres extending through the top section adjacent to the gasification region for process material including gases and vapors, the tuyeres being located closer to the bottom section of the vessel than the one or more feed ports.

2. The plasma gasification reactor of claim 1, wherein:

one or more of the feed ports extend through the cylindrical portion of the side wall of the lower portion of the top section.

3. The plasma gasification reactor of claim 1, wherein:

the one or more outlet ports extend through the roof of the vessel.

4. The plasma gasification reactor of claim 1, wherein:

the feed ports are configured to receive feed material from a distributive feed supply mechanism, and the distributive feed supply mechanism is controllable to vary the angle in either a horizontal plane or a vertical plane or both a horizontal plane and a vertical plane.

5. The plasma gasification reactor of claim 4, wherein:

the distributive feed supply mechanism is controllable for operation to vary the location of feed material to the interior of the top section as to distance from the feed port.

6. The plasma gasification reactor of claim 1, wherein:

the one or more feed ports are related to one or more supplies of feed material including one or more of coal, solid waste, and biomass;

the one or more tuyeres extending through the top section are related to one or more supplies of process material including one or more of air, oxygen, steam, and water; and the one or more feed ports supply process material deposited on the carbonaceous bed of the bottom section, to a depth that extends above the tuyeres of the top section, and gaseous reaction products, from reactions of the feed material, process material, and plasma fired carbonaceous bed, include carbon monoxide and hydrogen in a syngas exiting through the outlet ports.

7. The plasma gasification reactor of claim 1, wherein:

each feed port is characterized by arrangements for distribution of feed material including a protrusion into the vessel for material to enter other than next to the top section side wall and a distributive feed mechanism for injecting material with force, additional to gravity, into the vessel, wherein the distributive feed supply mechanism is controllable to vary the location of feed material to the interior of the top section as to distance from the feed port; and the distributive feed mechanism is connected with a controller for operation to vary the location of feed material to the interior of the top section as to both distance and angle from the feed port.

8. The plasma gasification reactor of claim 7, wherein:

the distributive feed supply mechanism includes an air blower for applying a mechanical force to the feed material.

9. The plasma gasification reactor of claim 1, wherein:

the cylindrical portion of the top section occupies up to about 20% of a vertical height of the top section.

10. The plasma gasification reactor of claim 1, wherein:

the side wall of the upper portion of the top section is tilted at an angle of between about 5° and about 25° with respect to the vertical axis of the vessel.

11. The plasma gasification reactor of claim 1, wherein:

each of the feed ports includes a protrusion extending into the vessel and angled downward from horizontal at an angle of about 60°.

12. The plasma gasification reactor of claim 11, wherein:

the protrusion includes an end from which feed material falls nearer to a center axis of the vessel than to the side wall.

13. The plasma gasification reactor of claim 1, wherein the first angle is smaller than the second angle by 5° or less.

14. The plasma gasification reactor of claim 1, wherein the carbonaceous bed includes at least one of fragmented foundry coke, petroleum coke, or mixed coal and coke, with an average cross-sectional diameter of about 5 cm to about 10 cm.

15. The plasma gasification reactor of claim 1, wherein:

a first plurality of the tuyeres extending through the top section are positioned above the bottom section at a location between about 5% and 15% of a distance between the bottom section and the roof; and a second plurality of the tuyeres extending through the top section are positioned above the bottom section at a location between about 10% and 30% of the distance between the bottom section and the roof.

16. A plasma gasification reactor vessel comprising:

a bottom section that includes space for a carbonaceous bed and has an exterior wall with one or more plasma torch ports;

a top section extending vertically up from the bottom section;

the top section including an upper portion containing a freeboard region and a lower portion containing a gasification region, the lower portion having an interior surface forming an inverse truncated cone with a narrowest cross-sectional diameter located where the top section is joined to the bottom section, a side wall of the upper portion being oriented at a substantially continuous first angle relative to a vertical axis of the vessel, and a side wall of the lower portion including first and second conical portions being oriented at a substantially continuous second angle relative to the vertical axis of the vessel, wherein the second angle is in a range of between about 5° and about 25° with respect to the vertical axis of the vessel;

a roof covering the top section;

one or more gas outlet ports in either or both of the top section and the roof;

one or more material feed ports in a cylindrical portion between the first and second conical portions of the side wall of the lower portion of the top section, for supply of feed material into the top section;

the top section having one or more tuyeres extending therethrough adjacent to the gasification region for process material including gases and vapors, the tuyeres being located closer to the bottom section of the vessel than the one or more feed ports; and a distributive feed supply mechanism configured to supply feed material to the one or more feed ports, and the distributive feed supply mechanism being controllable to vary a distribution of feed material in the top section.

17. The plasma gasification reactor of claim 16, wherein:

at least one of the material feed ports extends through the cylindrical portion of the side wall of the lower portion of the top section.

18. The plasma gasification reactor of claim 16, wherein:

the material feed ports include at least one with a distributive feed supply mechanism with a capability of dispersing feed material at varying locations within the top section relative to the position of the material feed port in the side wall.

19. The plasma gasification reactor of claim 18, wherein:

the distributive feed supply mechanism is controllable for operation to vary the location of feed material to the interior of the top section as to both distance and angle from the material feed port.

* * * * *